US005827631A

United States Patent [19]

Yoshihara et al.

[11] Patent Number: 5,827,631

[45] Date of Patent: Oct. 27, 1998

[54] NON-MAGNETIC ONE-COMPONENT DEVELOPER AND IMAGE FORMING PROCESS USING THE SAME

[75] Inventors: Koutarou Yoshihara; Seiichi Takagi; Toyofumi Inoue; Hiroyoshi Okuno; Tetsu Torigoe; Hiroe Okuyama; Masahiro Uchida, all of Minami-ashigara, Japan

[73] Assignee: Fuji Xerox Co., Ltd., Tokyo, Japan

[21] Appl. No.: 796,892

[22] Filed: Feb. 5, 1997

[30] Foreign Application Priority Data

Feb. 9, 1996 [JP] Japan ..... 8-023771

[51] Int. Cl.[6] ..... G03G 9/097

[52] U.S. Cl. ..... 430/110; 430/126

[58] Field of Search ..... 430/106, 109, 430/110, 126

[56] References Cited

U.S. PATENT DOCUMENTS

| | | | |
|---|---|---|---|
| 5,480,755 | 1/1996 | Uchiyama et al. | 430/110 |
| 5,484,678 | 1/1996 | Pickering et al. | 430/110 |
| 5,614,348 | 3/1997 | Inoue et al. | 430/110 |

FOREIGN PATENT DOCUMENTS

A-3-209265 9/1991 Japan .

*Primary Examiner*—John Goodrow

*Attorney, Agent, or Firm*—Oliff & Berridge, PLC

[57] ABSTRACT

A non-magnetic one-component developer comprising a binder resin, a colorant and a charge controlling agent, the binder resin being a polyester resin which has a number average molecular weight of from 2,500 to 3,500, a weight average molecular weight of from 8,000 to 15,000 and a softening point of from 110° C. to 130° C., and which is substantially free from an ingredient insoluble in tetrahydrofuran, and the charge controlling agent comprising a metal complex salt compound represented by the following formula (1):

(1)

wherein M represents a metal element selected from the group consisting of zinc, iron, nickel and cobalt, and $R^1$ and $R^2$ each represents a hydrogen atom or an alkyl group having from 1 to 6 carbon atoms.

15 Claims, 1 Drawing Sheet

NON-MAGNETIC ONE-COMPONENT DEVELOPER AND IMAGE FORMING PROCESS USING THE SAME

FIELD OF THE INVENTION

The present invention relates to a non-magnetic one-component developer and an image forming process using the same.

BACKGROUND OF THE INVENTION

At present, two-component development systems are most widely used. However, in using a developer, only a toner is consumed to decrease the concentration ratio of the toner contained in the developer. Accordingly, a concentration controller and the like for keeping the mixing ratio of the toner to carrier constant are required. Two-component development systems therefore are disadvantageous in that processors therefor become enlarged in size.

On the other hand, one-component development systems do not have the above-described problem because of no use of carriers, and are advantageous for miniaturization and lightening of processors therefor. The one-component development systems are therefore becoming the mainstream of development systems. Of the one-component development systems, magnetic one-component development systems are widely used in which a toner containing a magnetic substance is used. In these systems, however, the magnetic substance is contained in the toner, so that sharp color images can not be obtained.

There are non-magnetic one-component development systems as development systems suitable for formation of color images. In these development systems, no magnets are used in a developer carrier, which enables further miniaturization and cost reduction, and in recent years, they begin to be put to practical use in small-sized printers and the like.

In general, according to a non-magnetic one-component development apparatus, development is conducted as shown in FIG. 1, in which a non-magnetic one-component developer 5 contained in a developing tank 1 is supplied onto a developer carrier 4 with an agitator 2 and a toner supply roll 3 adjacent to the developer carrier 4, and then, a layer of the developer is formed with a charge (layer forming) blade 6, followed by adhesion of the developer to an electrostatic latent image formed on a photoreceptor drum 7. The toner remaining on the photoreceptor drum is removed with a cleaning blade 8.

In this system, a portion of the toner corresponding to the electrostatic latent image on the developer carrier is consumed, but other portions of the toner are recovered in the developing tank without consumption. The unconsumed toners are partly separated from the developer carrier 4 with the toner supply roll 3. The toner remaining on the developer carrier 4 passes, together with a toner freshly supplied with the toner supply roll 3, between the developer carrier 4 and the charge (layer forming) blade 6, and is used again for layer formation.

The above-described two-component developer comprises a carrier which is a stable charging and transferring member and, on the other hand, the magnetic one-component development system uses the magnetic force of a magnet roll which is a stable transferring and layer forming means. In contrast, the non-magnetic one-component development system is provided with no stable charge and transferring member, as shown in FIG. 1. In the non-magnetic one-component development system, it is therefore required to allow the toner to be stably retained on the developer carrier mainly by electrostatic force. Further, because the electrostatic force of the toner is generated on the charge blade, a rapid charging speed is required.

Then, in order to stabilize the charge of the toner, a charge controlling agent is previously added to insides of toner particles. As typical negative-charging charge controlling agents, chromium-containing azo dyes and salicylic acid compounds containing metals such as chromium, iron and zinc are used. Of these charge controlling agents, the chromium-containing azo dyes relatively rapidly provide high amounts of charge, but are inferior in charge-maintaining property. The use thereof for non-magnetic one-component development is therefore apt to raise the problem of fog or dirt associated with a decrease in the amount of charge in use for a long period of time. Further, the metal-containing salicylic acid compounds are superior to the chromium-containing azo dyes in charge-maintaining property, and the chromium-containing salicylic acid compounds have been commonly used among others because of a rapid charging speed and a high charge amount provided by them.

However, the use of developers containing these chromium-containing salicylic acid compounds for non-magnetic one-component development causes deterioration of the toners when used for a long period of time, because they have a wide charge distribution and poor charge exchangeability. As a result, toners of reversed polarity are increased, to thereby tend to raise the problem of fog or low image density. Thus, the chromium-containing salicylic acid compounds have disadvantages.

Further, in a color image forming process, several kinds of toner layers are superposed on one another, resulting in a thick toner image. This presents problems such that formation of cracks in the image, deterioration of luster, or development of image defects in bending takes place frequently due to lack of the toner strength. Then, polyester resins having a high molecular-cohesion are used as a binder resin for a color toner to be fixed, in order to keep appropriate luster and an aptitude for strength. However, the use of polyester resin having a high molecular weight for enhancing the toner strength results in the elevated softening point of the toner. It is therefore necessary to increase the fixing temperature of a heating roll. As a result, the fixing properties at low temperature, which are strongly desired in the toners, are deteriorated.

In order to solve these problems, a toner comprising a resin containing an ingredient soluble in tetrahydrofuran (THF) and having a peak in a specific molecular weight region, a polyester resin and a binder resin having an unsaturated bond is proposed in JP-A-3-209265 (the term "JP-A" as used herein means an "unexamined published Japanese patent application). This toner is excellent for prevention of electrostatic offset. However, internal additives such as a colorant in the toner are poorly dispersed, because the toner includes at least a gel ingredient. Therefore, this toner has problems such that the charging properties, the fixing properties and the image quality of copied images are adversely affected by the poor dispersion.

SUMMARY OF THE INVENTION

The present invention has been achieved to solve the above-described problems in the conventional techniques.

It is therefore an object of the present invention to provide a non-magnetic one-component developer which provides a stable charge amount and a transferring amount thereof even when used for a long period of time, and which further provides a high quality image with little fog.

Another object of the present invention is to provide a non-magnetic one-component developer which is unwilling to fly in a developing apparatus even when used for a long period of time.

A further object of the present invention is to provide a non-magnetic one-component developer which is excellent in toner separation, gives a fixing strength such that no image defect takes place by external stress, and has excellent fixing properties at low temperature and excellent resistance to offset, when fixed by a heating roll.

Other objects and effects of the present invention will be apparent from the following description.

In order to solve the above-described problems, the present inventors have conducted extensive studies. As a result, the present inventors have discovered that the above-described objects can be achieved by providing a non-magnetic one-component developer comprising at least a colorant, a specific charge controlling agent, a polyester resin having specific values of physical properties as a binder resin.

Therefore, the present invention relates to:

(1) a non-magnetic one-component developer comprising a toner which comprises a binder resin, a colorant and a charge controlling agent, the binder resin being a polyester resin which has a number average molecular weight (Mn) of from 2,500 to 3,500, a weight average molecular weight (Mw) of from 8,000 to 15,000 and a softening point (Tm) of from 110° C. to 130° C., and which is substantially free from an ingredient insoluble in tetrahydrofuran, and the charge controlling agent comprising a metal complex salt compound represented by the following formula (1):

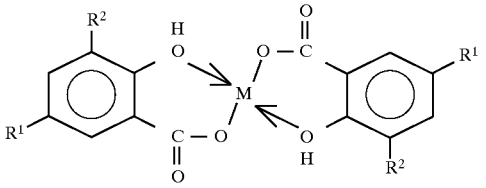

(1)

wherein M represents a metal element selected from the group consisting of zinc, iron, nickel and cobalt, and $R^1$ and $R^2$ each represents a hydrogen atom or an alkyl group having from 1 to 6 carbon atoms.

In a preferred embodiment, the polyester resin has an acid value of from 5 to 20.

Further, the present invention also relates to an image forming process comprising the steps of:

(a) forming a latent image on a latent image support;

(b) developing the latent image with a developer on a developer carrier;

(c) transferring the developed toner image onto an image-receiving member; and (d) fixing the toner image on the image-receiving member by heating, wherein the latent image is developed by using a thin layer of a non-magnetic one-component developer formed on the developer carrier in such a manner that the developer carrier and the latent image support are rotated in the same direction at a peripheral velocity ratio of the developer carrier to the latent image support of from 2.5:1 to 1:1, and wherein the non-magnetic one-component developer is that defined in the above (1).

The "same direction" used herein means that the moving direction of the developer carrier and that of the latent image support are the same in the facing area thereof (developing region), as shown in FIG. 1.

DETAILED DESCRIPTION OF THE INVENTION

Figure 1:
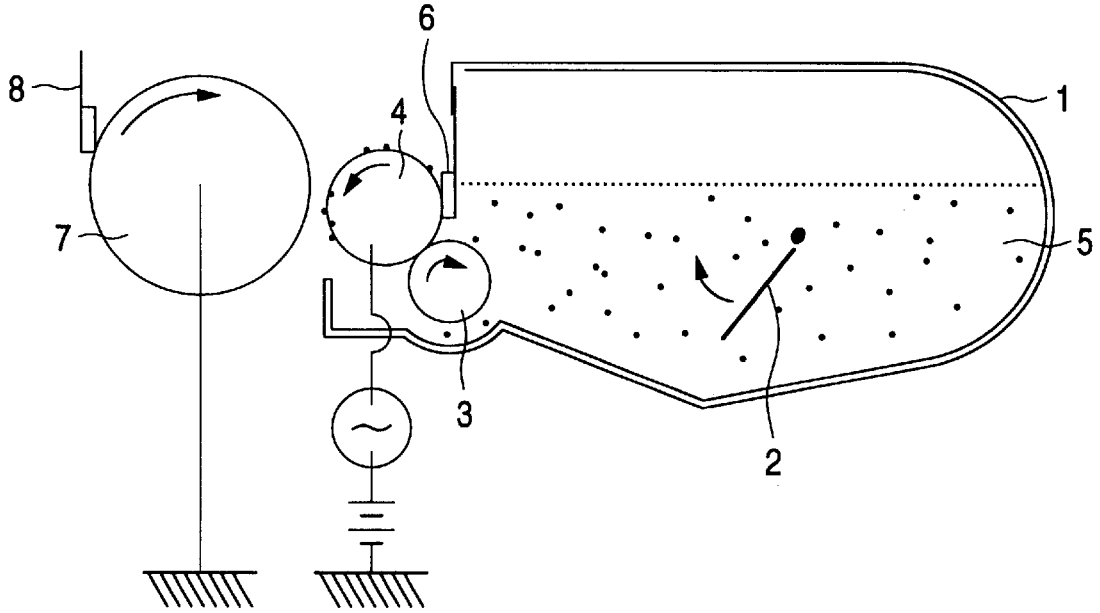
FIG. 1 is a schematic view illustrating an embodiment of a non-magnetic one-component development apparatus.

The present invention are described in detail below.

First, an image forming process in which a non-magnetic one-component developer of the present invention is used is described below. The non-magnetic one-component developer of the present invention is generally used in an image forming process comprising the steps of forming a latent image on a latent image support, developing the latent image with a specific developer formed into a layer form on a developer carrier to form a toner image, transferring the toner image onto an image-receiving member, and heat transferring the toner image transferred on the image-receiving member. In particular, the developer of the present invention is preferably used in a full-color image forming apparatus using four-color toners of yellow, magenta, cyan and black.

Known methods can be applied to the latent image formation step. The electrostatic latent image is formed on the latent image support such as a photosensitive layer or a dielectric layer by an electrophotographic method or an electrostatic recording method. The photosensitive layer used as the latent image support for use in the present invention include known layers such as those comprising an organic material, an amorphous silicon or the like. A cylindrical substrate therefor for use in the present invention may be obtained by a known manufacturing method, for example, by a method in which aluminum or an aluminum alloy is extruded to form the cylindrical substrate, followed by surface processing.

In the development stage, the non-magnetic one-component developer is formed into a thin layer on a rotary cylindrical member of the developer carrier (developing roll) with an elastic blade or the like, and carried to a developing region. The developing roll and the latent image support (photoreceptor drum) for holding the electrostatic latent image are arranged in contact with each other or spaced at a definite interval in the developing region, and the electrostatic latent image is developed with the non-magnetic one-component developer while applying bias voltage between the developing roll and the latent image support.

As the developer carrier for use in the present invention, a sleeve of an elastic material such as silicone rubber, or a sleeve obtained by drawing a metal such as aluminum and SUS stainless steel or a ceramic is employed. Also, sleeves having a surface which is oxidized, subjected to surface treatment such as polishing or blast treatment, or coated with a resin, for controlling the transferring properties and the charging properties of the developer may be used. The formation of the toner layer on the developing roll is carried out by bringing the elastic blade into abutting contact with the sleeve surface. As a material for the elastic blade, elastic materials such as silicone rubber and urethane rubber are preferably used. An organic or inorganic material may be added to and dispersed in the elastic material for controlling the charge amount of the toner.

In the development step in the present invention, the developer carrier and the latent image support are required to be moved in the same direction in the developing region at a peripheral velocity ratio of the developer carrier to the latent image support of from 2.5:1 to 1:1. The peripheral velocity ratio is preferably from 2:1 to 1.2:1.

In general, when a copied image is formed on plain paper, the ideal amount of the unfixed toner is from 0.5 to 1.5 $mg/cm^2$. To achieve the above unfixed toner amount, it is necessary to increase the amount of the toner developed. This can be achieved by increasing the toner amount on the developer carrier, or increasing the velocity of the developer carrier. However, an increase in the toner amount on the developer carrier raises the problems such that an after-image on the developer carrier appears to form a ghost image, and that the developer is poorly charged. Accordingly, the peripheral velocity ratio of the developer carrier to the latent image support is required to be adjusted within the above-described range. If the above-described peripheral velocity ratio exceeds 2, the toner becomes liable to fly from the developer carrier because of the relatively low charge amount of the non-magnetic one-component developer of the present invention, and the image density of a rear ingredient of the image becomes too high. On the other hand, if the peripheral velocity ratio is less than 1, a sufficient image density can not be obtained.

Examples of a method for developing using four-color toners of the present invention include a system in which four developing units are disposed around a photoreceptor, and each of charging, exposure and development steps is repeated four cycles using each of the toners, and a system in which charging, exposure and development of the four-color toners are conducted at one cycle. Examples of a system for superimposing the four-color toners on one another include a system in which toner images formed on a photoreceptor are transferred to an image-receiving paper wound on a transfer drum, color by color, to thereby superimpose them on one another, a system in which toner images formed on a photoreceptor are transferred onto an image-receiving member to superimpose the color toner images on one another, followed by collectively transferring the superimposed color toner images onto an image-receiving paper, and a system in which color toner images are superimposing on one another on a photoreceptor, followed by collectively transferring the superimposed color toner images onto an image-receiving paper.

Transfer means for use in the present invention include known means such as a contact type in which a latent image support is pressed on a transfer roll, and a non-contact type using a corotron.

In the fixing step, the toner image transferred onto the image-receiving member is fixed by a fixing device. As the fixing means, heat fixing systems using heat rolls are preferred. Roll fixing in which oil is applied for improving gloss and OHP image quality, or oilless fixing in which a surface lubricant is added to a toner for miniaturizing the device are carried out.

The cleaning step is a step in which the developer not transferred in the transfer step and left on the latent image support is removed with a cleaner. Cleaning means for use in the present invention include known means such as blade cleaning and roller cleaning. Elastic materials such as silicone rubber and urethane rubber are used in the blade cleaning.

The non-magnetic one-component developer for use in the above-described image forming process of the present invention is described below. The non-magnetic one-component developer of the present invention comprises a binder resin, a colorant and a charge controlling agent, wherein a specific polyester resin is used as the binder resin, and a specific metal complex salt compound is used as the charge controlling agent.

As the above-described charge controlling agent, the metal complex salt compound represented by formula (1) is used.

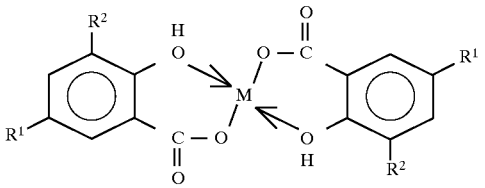

(1)

wherein M represents a metal element selected from the group consisting of zinc, iron, nickel and cobalt, and $R^1$ and $R^2$ each represents a hydrogen atom or an alkyl group having from 1 to 6 carbon atoms.

In the metal complex salt compounds represented by formula (1), M is most preferably zinc of the above-described metal elements. $R^1$ and $R^2$ are each more preferably a hydrogen atom or an alkyl group having from 4 or less carbon atoms for providing good dispersibility in the binder resin and good fixing properties.

Specific examples of the metal complex salt compounds represented by formula (1) for use in the present invention include salicylic acid-zinc complexes, salicylic acid-iron complexes, salicylic acid-nickel complexes, salicylic acid-cobalt complexes, alkyl salicylate derivative-nickel complexes, alkyl salicylate derivative-zinc complexes and alkyl salicylate derivative-iron complexes. The content of the above-described metal complex salt compound in the toner particles may be selected from the range of from 0.1 to 10% by weight, preferably from 1 to 6% by weight, depending on the requisite charge amount.

The polyester resin for use in the present invention is synthesized from a polyhydric alcohol and a polyvalent carboxylic acid.

Examples of the polyhydric alcohol component include ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexanedimethanol, dipropylene glycol, polyethylene glycol, polypropylene glycol, bisphenol A and hydrogenated bisphenol A.

In particular, the polyhydric alcohol component is preferably a combination of the above-exemplified polyhydric alcohol and a bisphenol A derivative represented by the following formula (2):

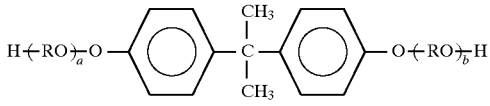

(2)

wherein R represents an ethylene group or a propylene group; and a and b each is an integer, and the sum of both is from 2 to 7.

Specific examples of the bisphenol A derivative include polyoxypropylene (6)-2,2-bis(4-hydroxyphenyl)propane, polyoxyethylene(2.2)-2,2-bis(4-hydroxyphenyl)propane and polyoxypropylene (2.0)-polyoxyethylene (2.0)-2,2-bis (4-hydroxyphenyl)propane.

Further, as the alcohol component which is tri- or more hydric, glycerin, sorbitol, 1,4-sorbitan and trimethylolpropane can be used.

Examples of the above-described polyvalent carboxylic acid component include maleic acid, maleic anhydride, fumaric acid, phthalic acid, terephthalic acid, isophthalic acid, malonic acid, succinic acid, glutaric acid, dodecenylsuccinic acid, n-octylsuccinic acid, 1,2,4-naphthalenetricarboxylic acid, 1,2,4-cyclohexanetricarboxylic acid, 1,2,5-hexanetricarboxylic acid, 1,3-carboxyl-2-methyl-2-methylenecarboxylpropane, tetra(methylenecarboxy)methane, 1,2,7,8-octyltetracarboxylic acid, trimellitic acid, trimellitic anhydride, pyromellitic acid and lower alkyl ester of these acids.

The polyester resin for use in the present invention is required to be free from an ingredient that is insoluble in tetrahydrofuran. Further, the polyester resin does not substantially contain a gel ingredient therein. Accordingly, the toner of the present invention has a good dispersion state of the charge-controlling agent and the colorant, and provides an image having a good light-transmittance on an OHP sheet. Further, the resulting developer of the present invention is hardly cracked and is resistant to stress, and thus exhibiting a good endurance against friction by a blade, etc. and good durability. In order to obtain such a polyester resin, it is necessary to prevent the molecular weight of the polyester resin to be produced from being increased too high by, for example, terminating the reaction at the time when the molecular weight reaches an appropriate range. In this preparation, the above-described tri- or more valent monomers can be used in combination in the reaction system.

Further, the polyester resin for use in the present invention is required to have a number average molecular weight (Mn) of from 2500 to 3500. A number average molecular weight exceeding 3500 results in deterioration of grindability to cause a reduction in productivity, whereas a number average molecular weight of less than 2500 results in a decrease in the toner image strength and that the resulting toner is readily ground by stress from respective members of a developing unit. Furthermore, the polyester resin is required to have a weight average molecular weight (Mw) of from 8000 to 15000. A weight average molecular weight exceeding 15000 results in deterioration of grindability, whereas a weight average molecular weight of less than 8000 results in reduced intermolecular cohesion of the polyester resin.

In addition to the above, the polyester resin for use in the present invention is required to have a softening point (Tm) of from 110° C. to 130° C. A softening point (Tm) of less than 110° C. results in failure to sufficiently ensure the non-offset temperature region, whereas a softening point exceeding 130° C. results in deterioration of fixing properties at low temperature. Further, the polyester resin preferably has a glass transition point (Tg) of from 60° C. to 75° C. A glass transition point of less than 60° C. results in deterioration of storage stability of the toner to raise a problem with regard to cohesion at high temperature and high humidity, whereas a glass transition point exceeding 75° C. results in difficulty of fixing at low temperature.

Further, the above-described polyester resin desirably has an acid value of from 5 to 20. If the acid value is less than 5, the use for a long period of time causes a possibility of fog in a non-image area and of image defects by transfer of the toner to the photoreceptor because of insufficient frictional charging properties by the charging blade. On the other hand, if the acid value exceeds 20, the number of hydrophilic groups is increased in the structure of the polyester resin. Accordingly, the toner varies in frictional charging properties by circumstances between under high temperature and high humidity, and low temperature and low humidity, unfavorably resulting in great dependence on fluctuations of the circumstance.

The non-magnetic one-component developer of the present invention comprises the metal complex salt compound represented by the above-described formula (1) as the charge controlling agent, and the polyester resin having the above-described specific properties as the binder resin, to thereby stabilize the charge amount and the transferring amount, even in the use for a long period of time. Even if the charge amount is low, the charge exchange is good because of narrow charge distribution. The developer is therefore advantageous in that only a small amount of a toner of reversed polarity is produced even if the toner is deteriorated by the use for a long period of time, to thereby hardly cause the problems of fog and low image density.

The colorants for the toner particles for use in the present invention include carbon black, Aniline Blue, Calco Oil Blue, Chrome Yellow, ultramarine blue, Du Pont Oil Red, Quinoline Yellow, Methylene Blue Chloride, copper phthalocyanine, Malachite Green Oxalate, lamp black, Rose Bengale, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1 and C.I. Pigment Blue 15:3. The content of the colorant is generally from 1 to 50% by weight, preferably from 2 to 12% by weight, based on the weight of the toner.

A surface lubricant may be further added to the toner particles for improving gloss and prevention of offset. As the surface lubricants, paraffins having 8 or more carbon atoms and polyolefins are preferably used. Examples thereof include paraffin wax, paraffin latex, microcrystalline wax, polypropylene and polyethylene. They can be used alone or in a combination of two or more thereof. The surface lubricant is preferably added in an amount ranging from 0.3 to 10 parts by weight per 100 parts of the toner. If the addition amount is less than 0.3 part by weight, it does not function as a surface lubricant in fixing. On the other hand, if the addition amount is more than 10 parts by weight, exposure thereof on the surface of the toner particles is increased, which causes poor charge to result in fly of the toner from the developer carrier and in deterioration of image quality. Further, adhesion among the toner particles, or interaction with a layer forming member or with the developer carrier is increased, so that a problem arises with regard to cleaning properties.

In the present invention, fine particles of a fluidizing agent are externally added to the toner particles for improving its fluidity, cleaning properties and charging properties. The fine particles of the fluidizing agents for use herein include fine powder of an inorganic compound such as hydrophobic silica, titania and alumina, fine powder of an organic compound such as fatty acids, derivatives thereof and metal salts thereof, and fine powder of a resins such as fluorine resins, acrylic resins and styrenic resins. They can be used alone or in a combination of two or more thereof. In particular, hydrophobic silica or titania having an average particle size of from 7 to 80 nm, particularly from 20 to 50 nm, is preferably used.

The above described fine powder is used in an amount of from 0.1 to 3 parts by weight, preferably from 0.3 to 1.5 parts by weight, per 100 parts by weight of toner. If the use amount is less than 0.1 part by weight, appropriate fluidity can not be imparted to the toner because of a low coating rate of the surface of the toner with the fine powder. On the other hand, if the amount is more than 3 parts by weight, the fine powder tends to adhere to the photoreceptor, to thereby cause comets and filming.

The toner particles for use in the present invention preferably have a volume average particle size of from 5 to 13 μm. A volume average particle size of less than 5 μm significantly deteriorates the fluidity, so that layer formation is not carried out well to cause fog and dirt. On the other hand, a volume average particle size of exceeding 13 μm reduces resolution to result in failure to obtain a high quality image. Further, the charge amount of the developer per unit weight is decreased in this case, so that the maintenance of layer formation tends to be deteriorated, to cause fog and dirt.

The toner particles for use in the present invention can be produced by any known methods. In particular, the particles produced by kneading and grinding systems are preferred. That is, a method is preferred in which the binder resin, the colorant, the surface lubricant and the like are melt-kneaded using a kneading apparatus such as a kneader or an extruder, the resulting product is cooled, followed by grinding, and the ground product is further classified.

The present invention will be described in more detail with reference to the following Examples, but the invention should not be construed as being limited thereto.

| Preparation Example 1 of Polyester Resin | |
|---|---|
| Bisphenol A/Propylene Oxide Adduct | 2.0 mol |
| Bisphenol A/Ethylene Oxide Adduct | 2.0 mol |
| Ethylene Glycol | 1.0 mol |
| Terephthalic Acid | 5.0 mol |

The above-described materials were placed in a 1-liter four-neck round bottom flask equipped with a stainless steel stirrer, a glass tube for introducing nitrogen gas and a flow-down type condenser, and the flask was set on a mantle heater. Then, nitrogen gas was introduced therein through the gas introducing tube. The flask was heated while keeping the inside of the flask under an inert gas atmosphere. Then, 0.05 g of dibutyltin oxide was added thereto, and the reaction temperature was maintained at 210° C. The reaction was conducted for about 5 hours, to thereby obtain polyester resin 1.

| Preparation Example 2 of Polyester Resin | |
|---|---|
| Bisphenol A/Propylene Oxide Adduct | 3.0 mol |
| Bisphenol A/Ethylene Oxide Adduct | 2.0 mol |
| Isophthalic Acid | 5.0 mol |

Using the above-described materials, polyester resin 2 was obtained in the same manner as in Preparation Example 1.

| Preparation Example 3 of Polyester Resin | |
|---|---|
| Bisphenol A/Propylene Oxide Adduct | 3.0 mol |
| Bisphenol A/Ethylene Oxide Adduct | 2.0 mol |
| Terephthalic Acid | 3.0 mol |
| Dodecenylsuccinic Acid | 1.8 mol |

The above-described materials were placed in a 1-liter four-neck round bottom flask equipped with a stainless steel stirrer, a glass tube for introducing nitrogen gas and a flow-down type condenser, and the flask was set on a mantle heater. Then, nitrogen gas was introduced therein through the gas introducing tube. The flask was heated while keeping the inside of the flask under an inert gas atmosphere. Then, 0.05 g of dibutyltin oxide was added, and the reaction temperature was maintained at 210° C. The reaction was conducted for about 5 hours. Thereafter, 0.2 mol of trimellitic acid and 0.07 g of dibutyltin oxide were added, and the reaction temperature was maintained at 210° C. The reaction was conducted for about 5 hours, to thereby obtain polyester resin 3.

| Preparation Example 4 of Polyester Resin | |
|---|---|
| Bisphenol A/Propylene Oxide Adduct | 3.0 mol |
| Bisphenol A/Ethylene Oxide Adduct | 2.0 mol |
| Isophthalic Acid | 3.0 mol |
| Dodecenylsuccinic Acid | 1.0 mol |

Using the above-described materials, polyester resin 4 was obtained in the same manner as in Preparation Example 3.

| Preparation Example 5 of Polyester Resin | |
|---|---|
| Bisphenol A/Propylene Oxide Adduct | 3.0 mol |
| Bisphenol A/Ethylene Oxide Adduct | 2.0 mol |
| Terephthalic Acid | 3.5 mol |
| Dodecenylsuccinic Acid | 1.0 mol |
| Trimellitic Acid | 0.5 mol |

Using the above-described materials, polyester resin 5 was obtained in the same manner as in Preparation Example 1, except that the reaction temperature and time were changed to 180° C. and 8 hours, respectively.

| Preparation Example 6 of Polyester Resin | |
|---|---|
| Bisphenol A/Propylene Oxide Adduct | 2.0 mol |
| Ethylene Glycol | 3.0 mol |
| Terephthalic Acid | 4.5 mol |
| Trimellitic Acid | 0.5 mol |

Using the above-described materials, polyester resin 6 was obtained in the same manner as in Preparation Example 1.

| Preparation Example 7 of Polyester Resin | |
|---|---|
| Bisphenol A/Propylene Oxide Adduct | 3.0 mol |
| Bisphenol A/Ethylene Oxide Adduct | 2.0 mol |
| Terephthalic Acid | 4.8 mol |
| Dodecenylsuccinic Acid | 0.2 mol |

Using the above-described materials, polyester resin 7 was obtained in the same manner as in Preparation Example 3, except that 0.5 mol of trimellitic acid was further added.

The physical properties of the polyester resins thus obtained are shown in Table 1.

TABLE 1

| | Molecular Weight | | | | THF Insoluble | |
|---|---|---|---|---|---|---|
| | Mn | Mw | Tm (°C.) | Tg (°C.) | Ingredient (%) | AV*) |
| Resin 1 | 3400 | 9500 | 112 | 68.3 | 0 | 9 |
| Resin 2 | 3000 | 14600 | 110 | 67.4 | 0 | 12 |
| Resin 3 | 3200 | 12000 | 110 | 69.0 | 0 | 15 |
| Resin 4 | 3400 | 10000 | 115 | 65.7 | 0 | 18 |
| Resin 5 | 9000 | 12000 | 120 | 73.0 | 0 | 15 |
| Resin 6 | 2000 | 19000 | 110 | 58.2 | 15 | 60 |
| Resin 7 | 2510 | 11000 | 105 | 70.3 | 0 | 35 |

Remarks:
*)AV represents an acid value

The molecular weight distribution was measured by a GPC method using tetrahydrofuran as the solvent. The glass transition point was determined using a temperature constituting a peak shoulder measured by the DSC method. The softening point was determined with a flow tester.

EXAMPLE 1

| | |
|---|---|
| Binder Resin: Resin 1 | 91 parts by weight |
| Colorant: Copper Phthalocyanine Pigment | 4 parts by weight |
| Charge Controlling Agent: Zinc bis{3,5-di-t-butylsalicylate} | 4 parts by weight |

The above-described materials were mixed using a Henschel mixer, and then, the resulting mixture was melt-kneaded at a set temperature of 140° C. at a screw revolution of 300 rpm at a feed speed of 150 kg/hour. After cooling, the resulting product was coarsely ground, followed by fine grinding in a jet mill. The ground product was further classified by air to obtain a classified product having a volume average particle size $D_{50}$ of 12.4 $\mu$m. To 100 parts by weight of the resulting classified toner, 0.8 part by weight of silicone oil-treated silica (having a particle size of 12 nm) and 1.2 parts by weight of titanium oxide having an average particle size of 50 nm were externally added, and mixed using a 75-liter Henschel mixer to obtain developer 1.

EXAMPLE 2

| EXAMPLE 2 | |
|---|---|
| Binder Resin: Resin 2 | 92 parts by weight |
| Colorant: C. I. Pigment Yellow 12 | 4 parts by weight |
| Charge Controlling Agent: Zinc bis{3,5-di-t-butylsalicylate} | 4 parts by weight |

Using the above-described materials, a classified product having a volume average particle size $D_{50}$ of 9.2 $\mu$m was obtained in the same manner as in Example 1. To 100 parts by weight of the resulting classified toner, 0.8 part by weight of silicone oil-treated silica (having a particle size of 12 nm) and 1.0 part by weight of titanium oxide having an average particle size of 50 nm were externally added, and mixed using a 75-liter Henschel mixer to obtain developer 2.

EXAMPLE 3

| EXAMPLE 3 | |
|---|---|
| Binder Resin: Resin 2 | 92 parts by weight |
| Colorant: C. I. Pigment Red 57:14 | 4 parts by weight |
| Charge Controlling Agent: Zinc bis{3,5-di-t-butylsalicylate} | 4 parts by weight |

Using the above-described materials, a classified product having a volume average particle size $D_{50}$ of 9.1 $\mu$m was obtained in the same manner as in Example 1. To 100 parts by weight of the resulting classified toner, 0.8 part by weight of silicone oil-treated silica (having a particle size of 12 nm) and 1.0 part by weight of titanium oxide having an average particle size of 50 nm were externally added, and mixed using a 75-liter Henschel mixer to obtain developer 3.

EXAMPLE 4

| | |
|---|---|
| Binder Resin: Resin 2 | 92 parts by weight |
| Colorant: Copper Phthalocyanine Pigment | 4 parts by weight |
| Charge Controlling Agent: Zinc bis{3,5-di-t-butylsalicylate} | 4 parts by weight |

Using the above-described materials, a classified product having a volume average particle size $D_{50}$ of 9.2 $\mu$m was obtained in the same manner as in Example 1. To 100 parts by weight of the resulting classified toner, 0.8 part by weight of silicone oil-treated silica (having a particle size of 12 nm) and 1.0 part by weight of titanium oxide having an average particle size of 50 nm were externally added, and mixed using a 75-liter Henschel mixer to obtain developer 4.

EXAMPLE 5

| | |
|---|---|
| Binder Resin: Resin 2 | 92 parts by weight |
| Colorant: Carbon Black | 4 parts by weight |
| Charge Controlling Agent: Zinc bis{3,5-di-t-butylsalicylate} | 4 parts by weight |

Using the above-described materials, a classified product having a volume average particle size $D_{50}$ of 9.3 $\mu$m was obtained in the same manner as in Example 1. To 100 parts by weight of the resulting classified toner, 0.8 part by weight of silicone oil-treated silica (having a particle size of 12 nm) and 1.0 part by weight of titanium oxide having an average particle size of 50 nm were externally added, and mixed using a 75-liter Henschel mixer to obtain developer 5.

EXAMPLE 6

| EXAMPLE 6 | |
|---|---|
| Binder Resin: Resin 3 | 88 parts by weight |
| Colorant: Copper Phthalocyanine Pigment | 4 parts by weight |

-continued

| EXAMPLE 6 | |
|---|---|
| Surface Lubricant: Polypropylene Wax | 4 parts by weight |
| Charge Controlling Agent: Zinc bis{3,5-di-t-butylsalicylate} | 4 parts by weight |

Using the above-described materials, a classified product having a volume average particle size $D_{50}$ of 12.5 μm was obtained in the same manner as in Example 1. To 100 parts by weight of the resulting classified toner, 1.0 part by weight of silicone oil-treated silica (having a particle size of 12 nm) and 1.5 parts by weight of titanium oxide having an average particle size of 50 nm were externally added, and mixed using a 75-liter Henschel mixer to obtain developer 6.

EXAMPLE 7

| | |
|---|---|
| Binder Resin: Resin 4 | 88 parts by weight |
| Colorant: Copper Phthalocyanine Pigment | 4 parts by weight |
| Surface Lubricant: Polypropylene Wax | 4 parts by weight |
| Charge Controlling Agent: Iron bis{3,5-di-t-butylsalicylate} | 4 parts by weight |

Using the above-described materials, a classified product having a volume average particle size $D_{50}$ of 7.8 μm was obtained in the same manner as in Example 1. To 100 parts by weight of the resulting classified toner, 1.0 part by weight of silicone oil-treated silica (having a particle size of 12 nm) and 1.5 parts by weight of titanium oxide having an average particle size of 50 nm were externally added, and mixed using a 75-liter Henschel mixer to obtain developer 7.

COMPARATIVE EXAMPLE 1

| COMPARATIVE EXAMPLE 1 | |
|---|---|
| Binder Resin: Resin 5 | 92 parts by weight |
| Colorant: Carbon Black | 4 parts by weight |
| Charge Controlling Agent: Zinc bis{3,5-di-t-butylsalicylate} | 4 parts by weight |

Using the above-described materials, a classified product having a volume average particle size $D_{50}$ of 12.5 μm was obtained in the same manner as in Example 1. To 100 parts by weight of the resulting classified toner, 0.8 part by weight of silicone oil-treated silica (having a particle size of 12 nm) and 1.2 parts by weight of titanium oxide having an average particle size of 50 nm were externally added, and mixed using a 75-liter Henschel mixer to obtain developer 8.

COMPARATIVE EXAMPLE 2

| COMPARATIVE EXAMPLE 2 | |
|---|---|
| Binder Resin: Resin 6 | 89 parts by weight |
| Colorant: Copper Phthalocyanine Pigment | 4 parts by weight |

-continued

| COMPARATIVE EXAMPLE 2 | |
|---|---|
| Surface Lubricant: Polypropylene Wax | 4 parts by weight |
| Charge Controlling Agent: Chromium disalicylate | 3 parts by weight |

Using the above-described materials, a classified product having a volume average particle size $D_{50}$ of 12.4 μm was obtained in the same manner as in Example 1. To 100 parts by weight of the resulting classified toner, 1.2 parts by weight of silicone oil-treated silica (having a particle size of 12 nm) and 1.5 parts by weight of titanium oxide having an average particle size of 50 nm were externally added, and mixed using a 75-liter Henschel mixer to obtain developer 9.

COMPARATIVE EXAMPLE 3

| | |
|---|---|
| Binder Resin: Resin 7 | 92 parts by weight |
| Colorant: Copper Phthalocyanine Pigment | 4 parts by weight |
| Charge Controlling Agent: Zinc bis{3,5-di-t-butylsalicylate} | 4 parts by weight |

Using the above-described materials, a classified product having a volume average particle size $D_{50}$ of 8.9 μm was obtained in the same manner as in Example 1. To 100 parts by weight of the resulting classified toner, 0.8 part by weight of silicone oil-treated silica (having a particle size of 12 nm) and 1.5 parts by weight of titanium oxide having an average particle size of 50 nm were externally added, and mixed using a 75-liter Henschel mixer to obtain developer 10.

COMPARATIVE EXAMPLE 4

| COMPARATIVE EXAMPLE 4 | |
|---|---|
| Binder Resin: Resin 1 | 92 parts by weight |
| Colorant: Copper Phthalocyanine Pigment | 4 parts by weight |
| Charge Controlling Agent: Aluminum disalicylate | 4 parts by weight |

Using the above-described materials, a classified product having a volume average particle size $D_{50}$ of 9.1 μm was obtained in the same manner as in Example 1. To 100 parts by weight of the resulting classified toner, 0.8 part by weight of silicone oil-treated silica (having a particle size of 12 nm) and 1.0 part by weight of titanium oxide having an average particle size of 50 nm were externally added, and mixed using a 75-liter Henschel mixer to obtain developer 11.

Image Forming Apparatus

Figure 2:
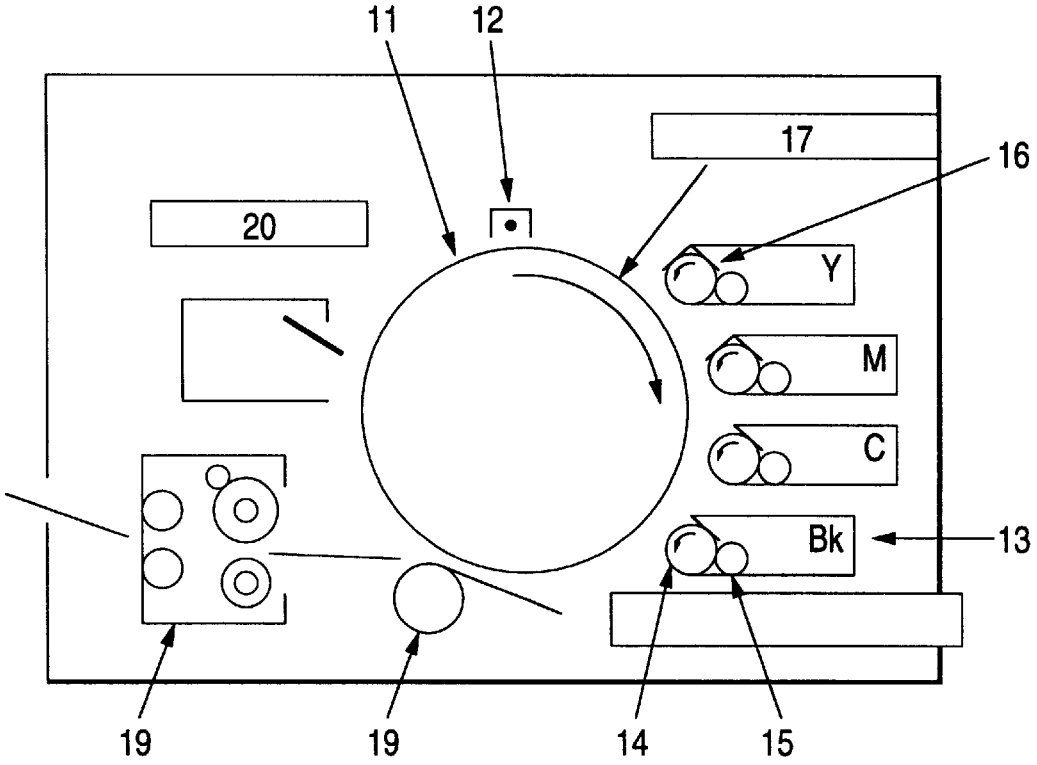
FIG. 2 is a schematic view illustrating an embodiment of an image forming apparatus that was used in image formation for evaluating image quality and the like in the present invention.

FIG. 2 schematically illustrates an image forming apparatus which was used in image formation for evaluating image quality and the like in the present invention. Four developing units 13 having yellow, magenta, cyan and black toners, respectively, were disposed around a latent image support 11 so that the spacing between developer carriers 14 and the latent image support 11 was constant. The latent image support 11 was charged with a charger 12, followed by exposure to a laser beam from a laser optical system 17 to form electrostatic latent images. Alternating current voltage and direct current voltage were applied to the developer carriers 14 and supply rolls 15 to be ready for developing the latent images, and charge, exposure and development of the four-color toners were conducted at four cycles. Toner layers were formed on the developer carriers by bringing rubber blades 16 for layer formation into abutting contact with the developer carriers 14 at a definite line pressure. The peripheral velocity of the latent image support 11 was 100 mm/second, and that of the developer carriers 14 was 150 mm/second. After the four-color toner images were superimposed on the latent image support (photoreceptor), they were collectively transferred onto an image-receiving paper using a transfer roll 18. The transferred images on the image-receiving paper were then fixed by a fixing device 19. A blade cleaner was used for cleaning means 20. The arrows shown in the latent image support 11 and the developer carriers indicate the directions of rotation thereof.

The images thus obtained were evaluated in accordance with the following criteria.

Fog;

⊙: Excellent,

○: Good,

Δ: Practically no problem, x: Trouble arose

Toner Flying;

⊙: Excellent,

○: Good,

Δ: Practically no problem, x: Trouble arose

Filming;

⊙: Excellent,

○: Good,

Δ: Practically no problem, x: Trouble arose

Overall Judgement;

⊙: Excellent,

○: Good,

Δ: Practically no problem, x: Trouble arose

The results thus obtained are shown in Table 3.

As described above, the non-magnetic one-component developer of the present invention comprises a toner having a sharp charge distribution and exhibiting less decrease of the charge amount, even if the toner is deteriorated by continuous use. Accordingly, problems such as fluctuations in image density, low developing properties, fog and contamination in the apparatuses do not arise in the use for a long period of time, and it is possible to obtain images having good fixed properties and having excellent image quality.

What is claimed is:

1. A non-magnetic one-component developer comprising a toner which comprises a binder resin, a colorant and a charge controlling agent, the binder resin being a polyester resin which has a number average molecular weight of from 2,500 to 3,500, a weight average molecular weight of from 8,000 to 15,000 and a softening point of from 110° C. to 130° C., and which is substantially free from an ingredient insoluble in tetrahydrofuran, and the charge controlling agent comprising a metal complex salt compound represented by the following formula (1) :

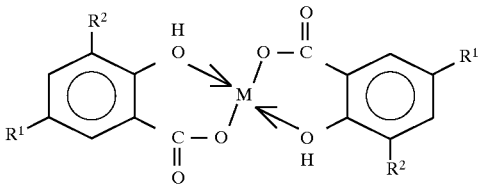

(1)

wherein M represents a metal element selected from the group consisting of zinc, iron, nickel and cobalt, and $R^1$ and $R^2$ each represents a hydrogen atom or an alkyl group having from 1 to 6 carbon atoms.

2. The non-magnetic one-component developer of claim 1, wherein the polyester resin has an acid value of from 5 to 20.

3. The non-magnetic one-component developer of claim 1, wherein the toner contains the charge controlling agent in an amount of from 1 to 10% by weight based on the weight of the toner.

4. The non-magnetic one-component developer of claim 1, wherein the polyester resin comprises a bisphenol A derivative as an alcohol component.

TABLE 3

| | Initial Density | Density after 10000 Copies | Fog | Toner Flying | Filming | Lowest Fixing Temp. | Hot Offset | Overall Judgement |
|---|---|---|---|---|---|---|---|---|
| Example 1 | 1.53 | 1.42 | ○ | ○ | ○ | 140 | >220 | ○ |
| Example 2 | 1.48 | 1.36 | ○ | ⊙ | ○ | 140 | >220 | ○ |
| Example 3 | 1.43 | 1.35 | ○ | ⊙ | ⊙ | 140 | >220 | ⊙ |
| Example 4 | 1.48 | 1.38 | ○ | ⊙ | ⊙ | 140 | >220 | ⊙ |
| Example 5 | 1.62 | 1.42 | ○ | ⊙ | ○ | 140 | >220 | ○ |
| Example 6 | 1.47 | 1.38 | ○ | ⊙ | ⊙ | 140 | >220 | ⊙ |
| Example 7 | 1.53 | 1.41 | ○ | ⊙ | ⊙ | 140 | >220 | ⊙ |
| Comparative Example 1 | 1.58 | 1.37 | Δ | Δ | x | 160 | >220 | x |
| Comparative Example 2 | 1.48 | 1.38 | x | x | Δ | 130 | 190 | x |
| Comparative Example 3 | 1.42 | 1.32 | Δ | Δ | x | 130 | 180 | x |
| Comparative Example 4 | 1.48 | 1.15 | x | x | x | 140 | >220 | x |

5. The non-magnetic one-component developer of claim 1, further comprises a surface lubricant.

6. The non-magnetic one-component developer of claim 5, wherein the surface lubricant comprises a polyolefin.

7. The non-magnetic one-component developer of claim 5, wherein the developer contains the surface lubricant in an amount of from 0.3 to 10% by weight based on the weight of the toner.

8. The non-magnetic one-component developer of claim 1, wherein the toner has a volume average particle size of from 5 to 13 $\mu$m.

9. The non-magnetic one-component developer of claim 1, wherein fine particles of a fluidizing agent are externally added to the toner particles.

10. An image forming process comprising the steps of:

(a) forming a latent image on a latent image support;

(b) developing the latent image with a developer on a developer carrier;

(c) transferring the developed toner image onto an image-receiving member; and (d) fixing the toner image on the image-receiving member by heating, wherein the latent image is developed by using a thin layer of a non-magnetic one-component developer formed on the developer carrier in such a manner that the developer carrier and the latent image support are rotated in the same direction at a peripheral velocity ratio of the developer carrier to the latent image support of from 2.5:1 to 1:1, and wherein the non-magnetic one-component developer comprises a toner which comprises a binder resin, a colorant and a charge controlling agent, the binder resin being a polyester resin which has a number average molecular weight of from 2,500 to 3,500, a weight average molecular weight of from 8,000 to 15,000 and a softening point of from 110° C. to 130° C., and which is substantially free from an ingredient insoluble in tetrahydrofuran, and the charge controlling agent comprising a metal complex salt compound represented by the following formula (1):

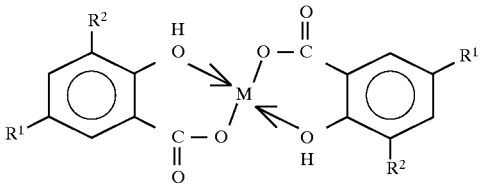

(1)

wherein M represents a metal element selected from the group consisting of zinc, iron, nickel and cobalt, and $R^1$ and $R^2$ each represents a hydrogen atom or an alkyl group having from 1 to 6 carbon atoms.

11. The image forming process of claim 10, wherein a full color image is formed by using a yellow toner, a magenta toner, a cyan toner and a black toner.

12. The image forming process of claim 11, wherein transferring step is conducted by using a transfer roll.

13. The image forming process of claim 10, wherein the peripheral velocity ratio is 2:1 to 1.2:1.

14. The non-magnetic one-component developer of claim 1, wherein $R^1$ and $R^2$ are each a hydrogen atom or an alkyl group having from 4 or less carbon atoms.

15. The non-magnetic one-component developer of claim 1, wherein the toner contains the charge controlling agent in an amount of from 1 to 6 percent by weight based on the weight of the toner.

* * * * *